US005813523A

United States Patent [19]

Gnadt et al.

[11] Patent Number: 5,813,523

[45] Date of Patent: Sep. 29, 1998

[54] SELF-SUPPORTING INSERT

[75] Inventors: David Frederic Gnadt, Owings Mills; Kevin Joseph Markey, Westminster, both of Md.

[73] Assignee: Lever Brothers Company, Division of Conopco, Inc., New York, N.Y.

[21] Appl. No.: 580,675

[22] Filed: Dec. 29, 1995

[51] Int. Cl.[6] ..... A47K 5/08

[52] U.S. Cl. ..... 206/77.1; 206/756; 206/776; 206/778; 206/590

[58] Field of Search ..... 206/485, 476, 206/730, 733, 756, 763, 776, 778, 589, 590, 77.1

[56] References Cited

U.S. PATENT DOCUMENTS

| | | | |
|---|---|---|---|
| 1,146,128 | 3/1915 | Hogg et al. | 206/776 |
| 1,930,235 | 10/1933 | Fox . | |
| 1,932,705 | 10/1933 | Menten . | |
| 2,353,376 | 7/1944 | Vatter . | |
| 2,582,476 | 1/1952 | Buttery | 206/778 |
| 2,649,807 | 8/1953 | Ritter | 206/778 |
| 2,744,622 | 5/1956 | Sparks | 206/590 |
| 2,827,219 | 3/1958 | Sparks . | |
| 3,093,290 | 6/1963 | Banks et al. . | |
| 3,475,525 | 9/1966 | Peters . | |
| 3,476,933 | 11/1969 | Mendelsohn . | |
| 4,109,786 | 8/1978 | Roccaforte et al. . | |
| 4,230,258 | 10/1980 | Lane | 206/590 |
| 4,300,683 | 11/1981 | Roccaforte . | |
| 4,462,135 | 7/1984 | Sanford . | |
| 5,144,744 | 9/1992 | Campagnoli . | |
| 5,172,806 | 12/1992 | Mickelberg | 206/756 |
| 5,358,116 | 10/1994 | Brintazzoli . | |

FOREIGN PATENT DOCUMENTS

| | | | |
|---|---|---|---|
| 455361 | 2/1950 | Italy | 206/485 |

*Primary Examiner*—David T. Fidei
*Attorney, Agent, or Firm*—Gerard J. McGowan, Jr.

[57] ABSTRACT

The present invention provides an insert, a blank for the insert and a combination of carton and insert, plus the combination of insert and cleansing agent bottle and the combination of insert plus cleansing agent bottle plus washing implement. The insert is designed to include five supports, three bottom supports and two top supports as part of the carton blank. The insert relies on the bottle for support. The insert stabilizes the cleansing agent bottle and the washing implement to minimize movement.

25 Claims, 4 Drawing Sheets

FIG. 1
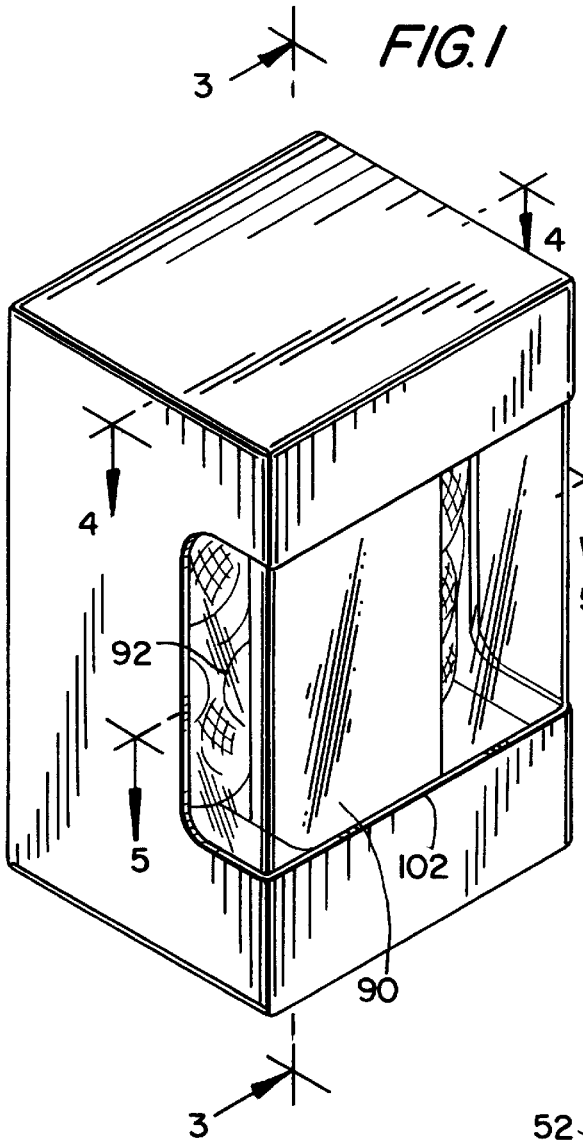
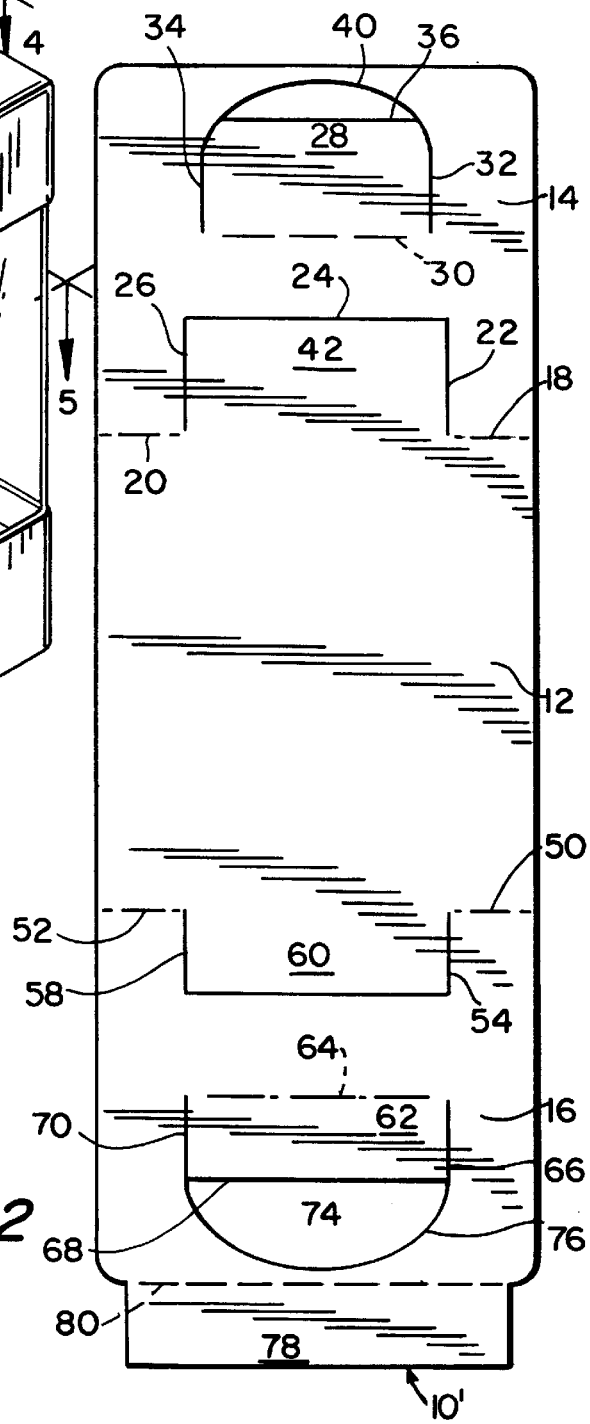
FIG. 2

SELF-SUPPORTING INSERT

BACKGROUND OF THE INVENTION

There has recently been great interest on the part of consumers in alternative forms of cleansing products. One such form is called the body wash. This is a liquid or gelled product which can be used as an alternative to the more traditional soap bars.

One problem with the use of these alternative washing products is that the consumer lacks an implement with which physically to wash. Many consumers are used to using the soap bar for scrubbing. Also, there may at times be a perception that the lathering which is obtained with the alternative products is not as copious as that which is obtained with many soap bars. As a result of these concerns, various implements have been considered for use in connection with alternative cleansing agents. These have included diamond-mesh sponges (also known as poufs) and other types of sponges such as reticulated sponges.

The increased use of washing implements has presented the packaging engineer with the need to package appealingly combinations of the new cleansing agents with the washing implements. Since the sponges tend to be porous, non-dense materials, it can be awkward to package them together with the cleansing agents, which are formulations and can be packaged in more traditional packages such as bottles.

Inserts have long been used in packaging. However, where used it is desirable that inserts comprise a minimal amount of material. In the case of the new washing products, if inserts are to be used they must function to support the cleansing agent and washing implement while displaying them attractively to the consumer.

Fox, U.S. Pat. No. 1,930,235 discloses a carton made from a single blank which has partitions for receiving and compartmentalizing beverage bottles or the like.

Menten, U.S. Pat. No. 1,932,705 discloses a receptacle for transporting articles comprising article supports at each end having aligned openings adapted to receive an end of the article.

Vatter, U.S. Pat. No. 2,353,376 is directed to a container including an inner merchandise containing slide member disclosed in, e.g., FIGS. 2 and 7.

Sparks, U.S. Pat. No. 2,827,219 discloses a container insert in, e.g., FIGS. 1 and 2.

Banks et al., U.S. Pat. No. 3,093,290 is directed to a carton having a product support at each end.

Roccaforte, U.S. Pat. No. 4,300,683 discloses a product display card having product securing orifices at each end.

Roccaforte, U.S. Pat. No. 4,109,786 discloses a carton having a product support at its top and its bottom.

Brintazzoli, U.S. Pat. No. 5,358,116 is directed to a package for products such as vials and the like having an element of support inserted into the box, which element has a U-shape and which element also includes a first wing having at least a first hole in which the body of the product is inserted and a second wing having at least a second hole coaxial with the first. The second hole has radial splits which form flexible segments which elastically hold the neck of the tubular product.

SUMMARY OF THE INVENTION

The present invention provides an insert, a blank for the insert and a combination of carton and insert, and a combination of insert plus cleansing agent bottle plus washing implement optionally with a carton. Preferably, the insert is designed to include a plurality of supports, especially five supports, which may include three bottom supports and two top supports, as part of the carton blank. The insert relies on the supports to stabilize the cleansing agent bottle and the washing implement to minimize movement and for a clean appearance in the carton. Some previous cartons with inserts have required false top and bottom for the carton. The need for this is eliminated with the insert of the present invention.

The insert is preferably made from a single unitary carton blank rather than multiple carton blanks. Again the carton with which the insert is used preferably does not include a false top and bottom; only closure flaps at the very top and the very bottom of the carton are required.

The insert of the invention includes a central panel and top and bottom panels. Both the top and bottom panels include flaps formed therein which are used to support the insert. Formation of the flaps also at least in part results in the formation of top and bottom product receiving apertures, which are suitable for holding the top and bottom of e.g. the cleansing agent bottle. Preferably, these apertures are disposed within the front two-thirds of the top and bottom panels so that a space is provided between the cleansing agent bottle and the central panel wherein the sponge or other washing implement may be disposed.

Another advantageous feature of the insert is that cuts are formed at the top and bottom ends of the central panel whereby top and bottom central panel extensions are formed to support the insert. These extensions respectively extend above and below the levels of the top and bottom panels so that the extensions together with the top and bottom panel supporting flaps provide parallel support for the top and bottom panels. In addition, the bottom panel includes an additional supporting flap which is distal to the central panel, at the front of the insert. Thus five supports, namely, the distal bottom panel flap, the top and bottom panel support flaps and the top and bottom central panel extensions are present.

When the cleansing agent container is received within the top and bottom apertures, the container assists in supporting the insert. The top and bottom panels in turn limit the movement of the cleansing agent container and also support the sponge. The sponge may be wedged between the cleansing agent bottle and the central panel whereby its position is stabilized between the top and bottom panels and the central panel and the cleansing agent bottle.

For a more complete understanding of the above and other features and advantages of the invention, reference should be made to the following detailed description of the preferred embodiments and to the accompanying drawings.

BRIEF DESCRIPTION OF THE DRAWINGS

FIG. 1 is a perspective view of a carton housing the insert of the invention together with a wag implement and a cleansing agent bottle.

FIG. 2 is a top plan view of a blank for the insert of the invention.

DETAILED DESCRIPTION OF THE INVENTION

Figure 6:
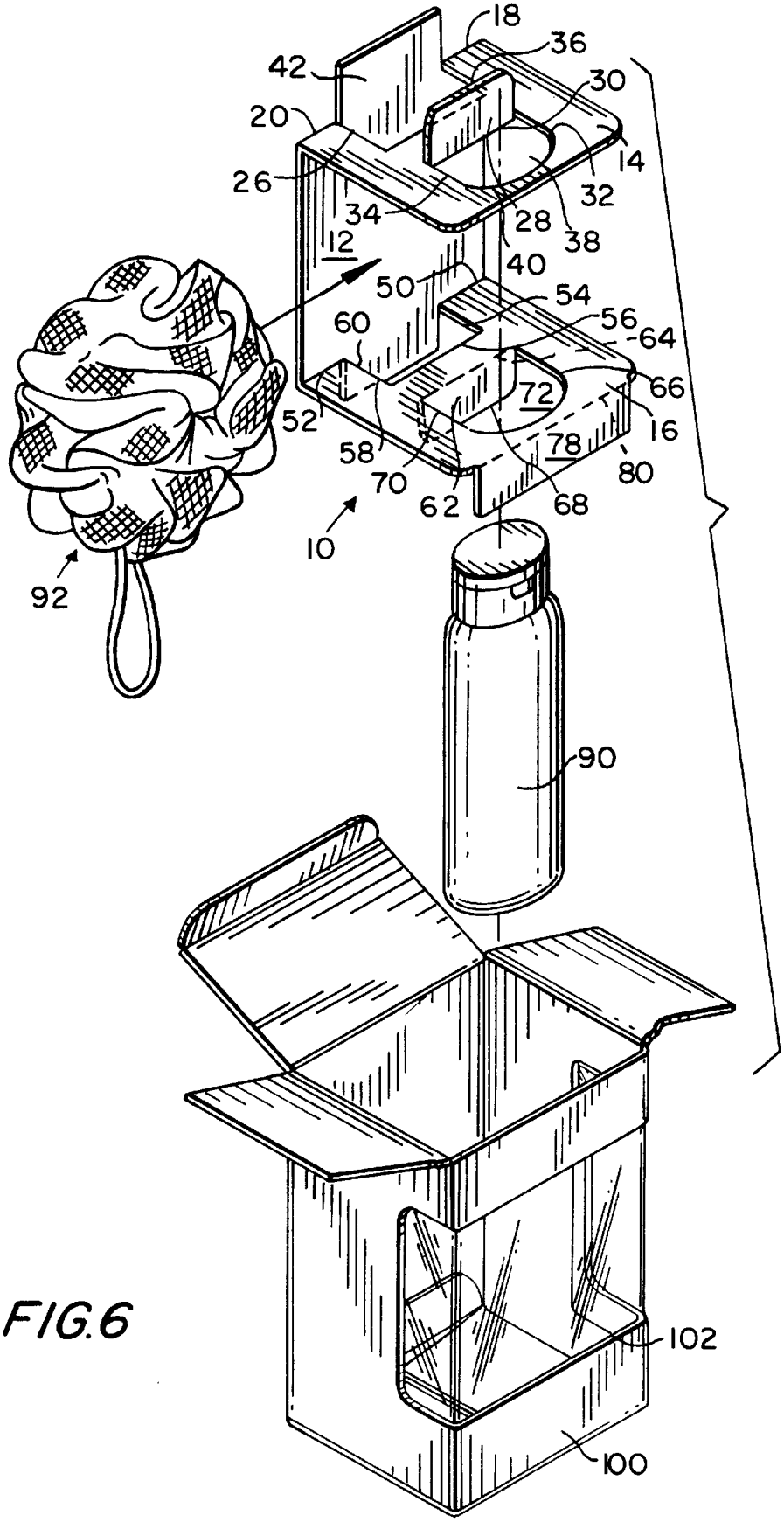
FIG. 6 is perspective view of an erected insert of the invention together with a carton, a cleansing agent bottle and a washing implement.

Referring to FIGS. 2 and 6, insert 10 comprises central panel 12, top panel 14 and bottom panel 16. The blank from which insert 10 is erected is denoted as reference 10' in FIG. 3.

Top panel 14 is separated in part from central panel 12 by lateral foldlines 18 and 20 on either side of the blank. Top panel 14 is also separated from central panel 12 by full cut lines 22, 24 and 26. Flap 28 is formed from top panel 14 by interrupted cut line 30 and by cut lines 32, 34 and 36.

Aperture 38 is formed in top panel 14 partially as a result of folding upwardly flap 28 and partially from curve cut line 40.

Folding at lateral foldlines 18 and 20 and the cuts at lines 22, 24 and 26 results in formation of an extension 42 to the central panel 12. As can be seen in FIG. 6, flap 28 and central panel top extension 42 extend the same distance above top panel 14. This is done so that both flaps will support the insert by just touching the bottom of the top closure panels or flaps of the carton and eliminate the need for a false bottom of the carton. The bottom of the carton's top closure panels or flaps will be generally parallel to panel 14.

Bottom panel 16 is separated from central panel 12 by bottom lateral scorelines 50 and 52 and by full cut lines 54, 56 and 58. The presence of the foldlines 50 and 52 on the sides of the central panel and the cut lines 54, 56 and 58 result in the formation of a bottom extension 60 to central panel 12.

Formed within the front two-thirds of bottom panel 16 is flap 62, which is defined by interrupted cut line 64 and by cut lines 66, 68 and 70. When flap 62 is folded downwardly as shown in FIG. 6, aperture 72 is formed in bottom panel 16. Aperture 72 includes the opening formed by folding flap 62 downwardly as well as the opening 74 formed in the blank by cut line 68 and curved cut line 76.

At the distal or front end of bottom panel 16 is supporting flap 78 which is separated from panel 16 by interrupted cut line (fold line) 80.

As can be seen from FIG. 6, extension 60 and flaps 62 and 78 extend approximately the same distance below bottom flap 16. These flaps and extension support bottom flap 16 within the carton, just as flap 28 and extension 42 help stabilize the position of top flap 14 against the top closure flaps of the carton. The bottom closure panels and/or flaps will be generally parallel to flap 16.

Figure 3:
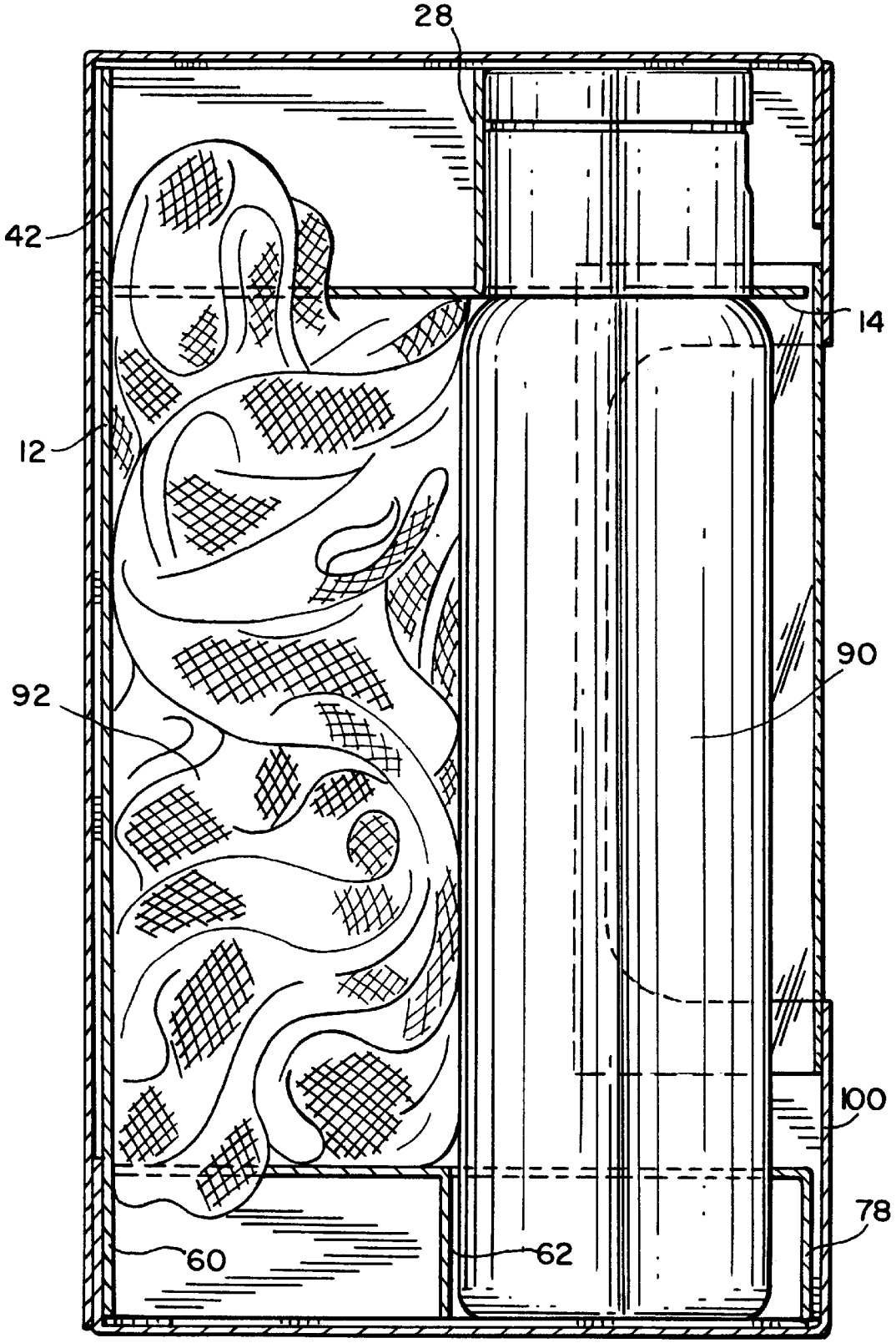
FIG. 3 is a cross section above the lines 3—3 of FIG. 1.
Figure 4:
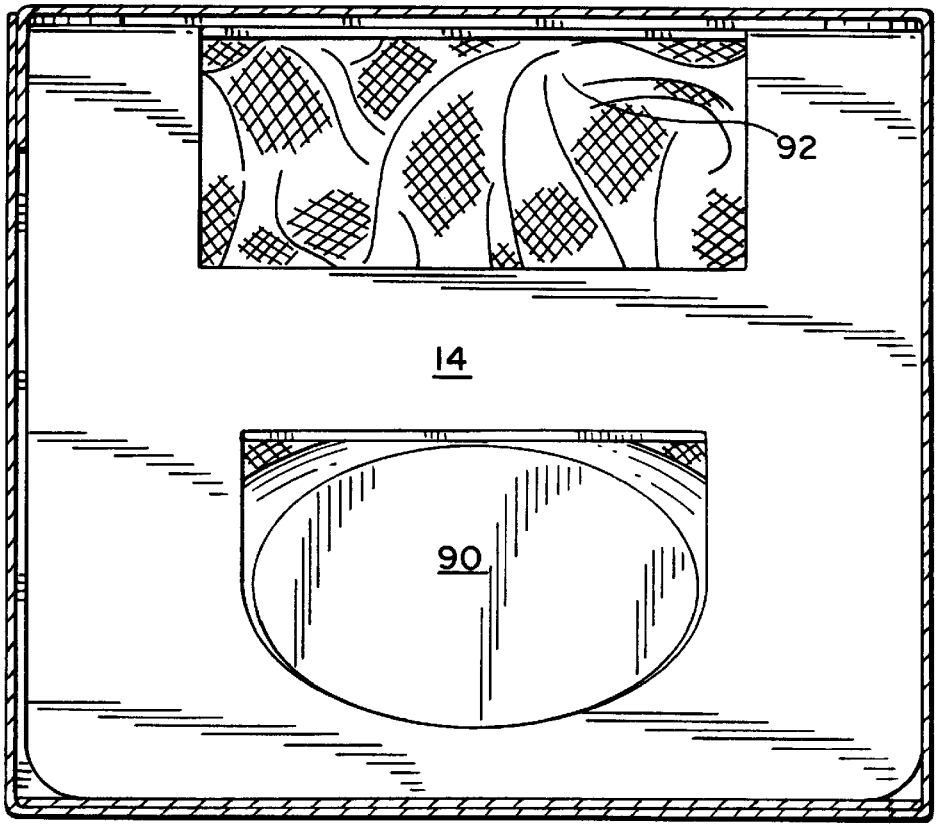
FIG. 4 is a cross section along the lines 4—4 of FIG. 1.
Figure 5:
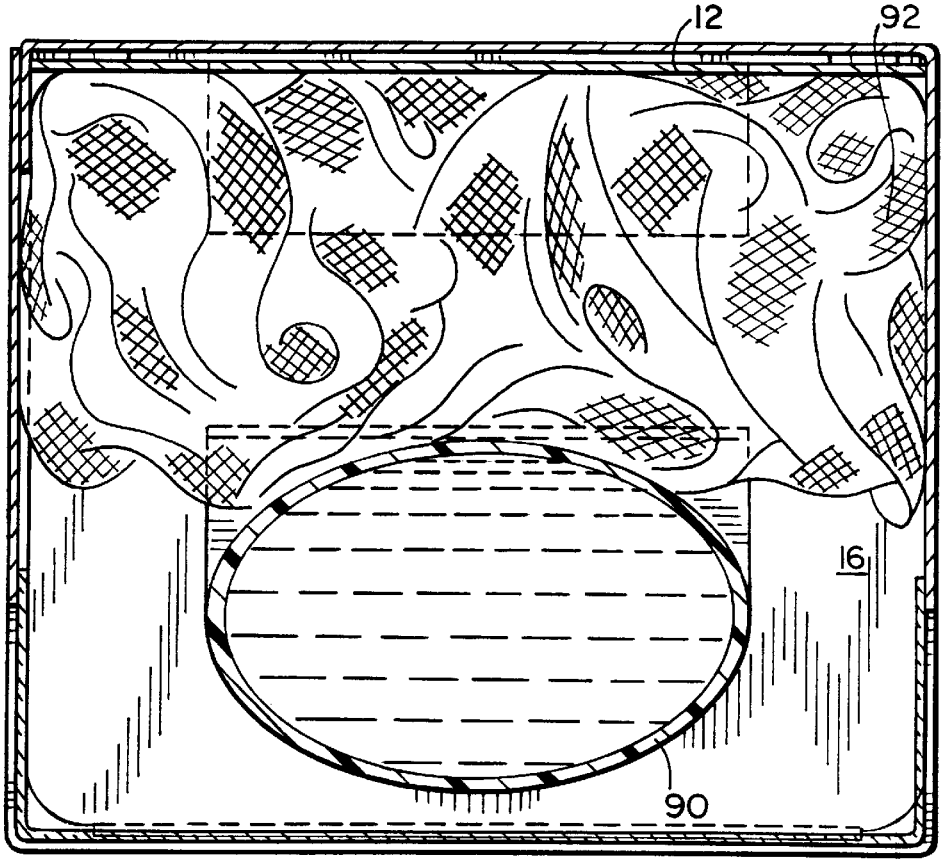
FIG. 5 is cross section along the lines 5—5 of FIG. 1.

As best seen in FIGS. 2 and 3, cleansing agent bottle 90 is received within bottom aperture 72 and top aperture 38. Preferably, the apertures are dimensioned so that the container is snugly received within the apertures. The bottle can therefore provide some support to the insert, particularly to top panel 14.

As indicated above, preferably, as illustrated in FIG. 6, apertures 38 and 72 are disposed within two-thirds of the top and bottom panels distal to the central panel 12. This leaves room for the washing implement, such as sponge 92 illustrated in FIGS. 1 and 3–6. Sponge 92 is snugly accommodated between bottle 90 and central panel 12. Thus, bottle 90 is retained within apertures 72 and 38 of the insert whereas sponge 92 is retained between bottle 90 and central panel 12 and also is confined by top panel 14 and bottom panel 16.

The blank 10' is used by folding bottom and top panels 14 and 16 in the same direction perpendicularly to central panel 12. Then, top flap 28 is folded perpendicularly and upwardly from top panel 14 and bottom flap 62 is folded downwardly and perpendicularly to bottom flap 16. Then, bottom support flap 78 is folded downwardly and perpendicularly to bottom panel 16. The washing agent container is then placed within apertures 72 and 38 and the sponge 92 is inserted behind bottle 90. The insert as thus assembled is then slid into carton 100 through either open top or bottom panels or flaps.

The insert holds the sponge 92 and bottle 90 stably in position within carton 100. Display window 102 of carton 100 permits consumers to view the bottle 90 and sponge 92. As mentioned earlier, flaps 78 and 62 and bottom extension 60 support the insert against the bottom closure flaps of carton 100. Flap 28 and extension 42 stabilize top flap 14 against the top closure panels of carton 100. Flaps 78, 62, 28 and extensions 60 and 42 avoid the need for false top and bottom panels, e.g., panels spaced from the top and bottom of the carton, in the carton 100. That is, only closure panels and/or flaps at the very top and very bottom of the carton are required.

The insert and the carton may be made of paperboard. The container for the cleansing agent may be a bottle or a carton or other suitable container. If a bottle, it will preferably be made of a plastic material. If a carton, the cleansing agent container may be either plastic or paperboard or some combination thereof.

The washing implement may be a sponge formed from polymeric diamond mesh material, also known as a pouf. The pouf may be made by gathering an endless diamond mesh tube, stretching the tube, binding the tube at the center and releasing the tube from the stretched condition to rebound into a rounded sponge shape. Alternatively, a pouf may be made in accordance with the procedure disclosed in Campagnoli, U.S. Pat. No. 5,144,744 which involves stretching a plurality of tubes, binding the tubes together near a common center of all the stretched tubes and releasing all the tubes from their stretched condition to form the rounded sponge shape.

The mesh material may be made of addition polymers of olefin monomers other than ethylene or of polyamides of polycarboxylic acids and polyamines. An alternative mesh material is nylon. The tubular netting mesh from which poufs are formed are preferably strong, flexible polymeric materials. Such mesh materials are described in e.g Sanford, U.S. Pat. No. 4,462,135, the disclosure which is incorporated herein by reference. The cord for the sponge, if present, may be made of a natural material such as rope or a synthetic material polymer such as nylon, polyethylene or polypropylene.

It has been suggested that the diamond-mesh poufs coact with washing formulations which include surfactant and a skin moisturizer. Whether or not a pouf is used, the washing agent may be a liquid personal wash cleaning formulation which includes a surfactant and a skin conditioning and moisturizing ingredient. Preferably the surfactant is a mild surfactant. Among the mild surfactants which may be used are cocamidopropyl betaine and sodium cocoylisethionate. Among other surfactants which may be used are soap and sodium laureth sulfate. Among the moisturizers which may be used are glycerine mono, di and tri-esters, mineral oil and silicone oil. A preferred moisturizer is the dimethicone emulsion sold as Dow Q2-1656, which is a 50% silicone emulsion. Thickeners such as ammonium sulfate and opacifiers such as mica/titanium dioxide may be used.

A preferred washing implement is a reticulated, i.e., open-celled sponge. The sponge may be made of any suitable polymeric material such as polyethylene. Advantageously the sponge is somewhat resilient.

In the case of the reticulated sponge, the sponge is preferably formed from a reticulated foam. Preferably the foam is made from a synthetic polymer. The foam is preferably within the pore size range of 10 to about 100 pores per linear inch, especially from 10 to 60 pores per linear inch. Foams are available from companies such as Scott Paper Company of Chester, Pa. Methods for reticulation of open celled plastic foams are described in U.S. Pat.

Nos. 3,475,525 and 3,476,933, which are incorporated by reference herein.

It may be desirable to vary the pore size to influence the formation of foam. For an immediate transfer of foam, a large cell size of 40 to 90 cells per square inch, especially from 40 to 70, may be used. For intermediate foam transfer, 91 to 145, especially from 100 to 130 cells per square inch may be used. For long lasting foam retention, from 146 to 200, particularly from 170 to 200 cells per square inch may be employed.

It may also be desirable to include varied pore sizes on the sponge. For instance, the top surface of the sponge may have cells within one of the above ranges, e.g. designed for immediate transfer and the bottom surface may have cells within a different range, e.g. designed for long lasting foam retention. For instance, this may be achieved by laminating two or more layer of sponge together, each layer having a different pore size.

Foams which may be reticulated for the washing implement in accordance with the invention include polyurethane, polyester, polyethylene, polyether, polyester base urethane, and polyolefins such as polypropylene, silicate foams, ceramic foams, latex and natural rubber foams and cellulose sponges. Polyether base urethane reticulated foams are particularly preferred because of their enhanced resistance to moisture and solvents. Polyvinyl alcohol may be used.

Pore diameters may, for example, be in the range of 300–400 microns.

It should be understood of course that the specific forms of the invention herein illustrated and described are intended to be representative only as certain changes may be made therein without departing from the clear teachings of the disclosure. Accordingly reference should be made to the following appended claims in determining the full scope of the invention.

What is claimed is:

1. An insert comprising:

a) a central panel, b) a top panel separated from said central panel by lines of weakness, c) a bottom panel opposite said top panel and separated from said central panel by lines of weakness, d) said top panel comprising a top stabilizing flap formed from within said top panel and attached to said top panel by a fold line, e) a top aperture being formed in said top panel at least when said top supporting flap is folded perpendicularly to said top panel, f) said bottom panel including a bottom supporting flap formed from within said bottom panel and attached to said bottom panel by a fold line, g) a first bottom aperture being formed in said bottom panel at least when said bottom flap is folded perpendicularly to said bottom panel, h) said bottom supporting flap supporting said bottom when said insert is in place in a carton, i) said top stabilizing flap stabilizing said top panel when said insert is in place in a carton.

2. An insert comprising:

a) a central panel having a top and a bottom, b) a top panel perpendicular to said central panel and separated therefrom by lines of weakness, c) a top central panel extension extending from said top of said central panel adjacent said lines of weakness separating said central and top panels and extending parallel to said central panel, d) a top aperture being formed in said top panel at least when said top central panel extension is folded perpendicularly to said top panel, e) a bottom panel opposite said top panel and separated from said central panel by lines of weakness, f) a bottom central panel extension extending from said bottom of said central panel adjacent said lines of weakness separating said central and bottom panels and extending parallel to said central panel, g) a first bottom aperture being formed in said bottom panel at least when said bottom central panel extension is folded perpendicularly to said bottom panel.

3. The insert according to claim 2 wherein said bottom panel includes a support flap formed therein and separated from said bottom panel by lines of weakness, said support flap being folded to support said bottom panel whereby an aperture is formed and wherein said top panel includes a stabilizing flap formed therein and separated from said top panel by lines of weakness, said stabilizing flap being folded to stabilize said top panel whereby an aperture is formed.

4. A blank for forming a carton insert comprising a central panel, a top panel separated from said central panel at least partially by a first fold line, a top panel stabilizing flap formed within said top panel and defined by cuts in said top panel and by a second fold line, said top panel further including a top product receiving aperture, a bottom panel separated from said central panel at least partially by a third fold line on an opposite side of said central panel from said top panel, a bottom panel supporting flap formed within said bottom panel and defined by cuts in said bottom panel and by a fourth fold line, said bottom panel further including a bottom product receiving aperture.

5. A combination carton and insert comprising a carton having a front panel, side panels on either side thereof, a rear panel, between said side panels, said front panel having a display opening, top closure flaps at a top thereof, bottom closure flaps at a bottom thereof, and an insert contained therein including:

a) a central panel, b) a top panel separated from said central panel by lines of weakness, c) a bottom panel opposite said top panel and separated from said central panel by lines of weakness, d) said top panel comprising a top panel stabilizing flap formed from within said top panel and attached to said top panel by a fold line, e) a top aperture being formed in said top panel at least when said top panel stabilizing flap is folded perpendicularly to said top panel, f) said bottom panel including comprising a bottom panel supporting flap formed from within said bottom panel and attached to said bottom panel by a fold line, g) a first bottom aperture being formed in said bottom panel at least when said bottom panel supporting flap is folded perpendicularly to said bottom panel, said central panel of said insert being disposed adjacent said carton rear panel, h) said top panel stabilizing flap stabilizing said top panel with respect to the top of the carton and said bottom panel supporting flap supporting said bottom panel.

6. The combination carton and insert according to claim 5, further comprising a bottle received with said top and bottom panel apertures, supporting said insert.

7. The combination carton and insert according to claim 5 further comprising a central panel top extension extending above the level of the top panel and a central panel bottom extension extending below the level of the bottom panel, said bottom extension supporting said bottom panel and said top extension stabilizing said top panel.

8. The insert according to claim 1 wherein said insert does not include a panel extending parallel to said central panel from said top and bottom panels.

9. The insert according to claim 1 wherein said insert does not include a panel extending from said top panel to said bottom panel additional to said central panel.

10. The insert according to claim 1 further comprising a front support flap separated from said bottom panel by a fold line.

11. The insert according to claim 1 wherein said lines of weakness forming said bottom panel are spaced from a bottom edge of said central panel whereby a second bottom aperture is formed in said bottom panel.

12. The insert according to claim 1 in combination with a package having two ends, a first said end being received within said top aperture and a second end being received within said first bottom aperture, said package supporting the top panel.

13. The combination according to claim 12 wherein said package comprises a bottle.

14. The combination according to claim 12 wherein said package comprises a carton.

15. The combination according to claim 12 further comprising a sponge disposed between said package and said central panel.

16. The combination according to claim 15 wherein said sponge comprises a diamond mesh pouf.

17. The insert according to claim 1 wherein said lines of weakness forming said top panel are spaced from a top edge of said central panel whereby a second top aperture is formed in said top panel.

18. The insert according to claim 1 wherein said top and bottom apertures are disposed within the distal two thirds of the top and bottom panels.

19. The blank according to claim 4, not having a panel which is suitable to extend between the top and bottom panels other than the central panel.

20. The blank according to claim 4 wherein said bottom flap further comprises a support panel distal to said aperture separated from said bottom panel by a fold line on a side opposite said central panel.

21. The blank according to claim 4 wherein said bottom product receiving aperture is formed partially by an opening formed when said bottom panel supporting flap is folded downwardly from said bottom panel.

22. The blank according to claim 4 wherein said top product receiving aperture is formed partially by an opening formed when said top panel stabilizing flap is folded upwardly from said top panel.

23. The blank according to claim 4 wherein said fold line separating said bottom and central panels extends across only a portion of the width of the blank and said central panel is further defined by cuts forming a proximal bottom support flap section of said central panel extending below the fold line separating the central and bottom panels, said fold line being disposed on two sides of said cuts.

24. The blank according to claim 4 wherein said fold line separating said top and central panels extends across only a portion of a width of the blank and said central panel is further defined by cuts forming a proximal top support flap section of said central panel extending above the fold line separating the central and top panels, said fold line being disposed on two sides of said cuts.

25. The combination of claim 5 wherein said carton does not include false bottom or top closure flaps.

* * * * *